United States Patent [19]

Wulz et al.

[11] 3,980,863

[45] Sept. 14, 1976

[54] ELECTROPHOTOGRAPHIC COPYING MACHINES

[75] Inventors: Helmut Wulz; Paul Heinzer, both of Zurich, Switzerland

[73] Assignee: Wifo Wissenschaftliches Forschungs-Institut A.G., Zurich, Switzerland

[22] Filed: Nov. 8, 1974

[21] Appl. No.: 522,128

[30] Foreign Application Priority Data

Nov. 16, 1973 Switzerland ..... 16141/73

[52] U.S. Cl. ..... 219/388; 219/216; 219/347; 219/374; 432/59; 432/230

[51] Int. Cl.[2] ..... F27B 9/06

[58] Field of Search ..... 219/216, 244, 347, 374, 219/383, 384, 388, 405, 411, 525; 432/59, 60, 229, 230; 165/64; 355/9; 34/77

[56] References Cited

UNITED STATES PATENTS

| | | | |
|---|---|---|---|
| 2,454,370 | 11/1948 | Beaubien | 219/388 |
| 2,719,903 | 10/1955 | Oertli | 219/525 |
| 2,820,131 | 1/1958 | Kodama | 219/388 |
| 3,078,589 | 2/1963 | Carlson | 34/77 |
| 3,079,483 | 2/1963 | Codichini et al. | 219/388 |
| 3,123,700 | 3/1964 | Snyder et al. | 219/388 |
| 3,162,561 | 12/1964 | Farluas | 219/244 X |
| 3,249,741 | 5/1966 | Mills | 219/388 |
| 3,348,022 | 10/1967 | Schirmer | 219/384 |
| 3,376,406 | 4/1968 | Phelps | 219/388 |
| 3,420,982 | 1/1969 | Hager, Jr. | 219/388 |
| 3,449,547 | 6/1969 | Goodman et al. | 219/216 |
| 3,478,665 | 11/1969 | Umahashi et al. | 219/216 |
| 3,515,854 | 6/1970 | Williams | 219/388 |
| 3,578,797 | 5/1971 | Hodges et al. | 263/3 |
| 3,744,557 | 7/1973 | Costello | 165/64 |
| 3,757,081 | 9/1973 | Smith et al. | 219/216 |
| 3,806,314 | 4/1974 | Obuchi et al. | 432/230 |
| 3,810,735 | 5/1974 | Moser | 432/59 |
| 3,826,892 | 7/1974 | Draugelis et al. | 219/216 |

*Primary Examiner*—Volodymyr Y. Mayewsky
*Attorney, Agent, or Firm*—Stewart and Kolasch, Ltd.

[57] ABSTRACT

Apparatus for fixing electrophotographic images produced by an electrophotographic copying machine, comprising a conveyor belt for transporting image bearing sheets on its upper run and a planar heater which extends substantially parallel to the upper run and is disposed closely above it but out of contact with the sheets.

18 Claims, 10 Drawing Figures

ELECTROPHOTOGRAPHIC COPYING MACHINES

This invention relates to apparatus for fixing electrophotographic images which have been produced in a photocopying machine by imagewise exposure to light of electrically charged electrophotographic material, followed by application of toner powder.

Such images are fixed by application of heat to fuse the particles of toner powder to the portions of the image which have accepted the particles. In one known form of fixing apparatus, the images are subjected to a current of air circulating in a substantially enclosed circuit containing a heater for heating the circulating air. The heated air passes over the surface of each image to preheat the carrier of the image and also the particles of toner powder deposited selectively on the carrier to define the image and the apparatus includes two further heaters in series which complete the fixing of the image.

This apparatus has the disadvantage that all parts which are in contact with the circulating air must be heated sufficiently before copying can be commenced in the copying machine which supplies the images to the fixing apparatus and this can involve a delay of several minutes, because when the copying machine is stopped, the heaters in the fixing apparatus are switched off and the resulting cooling of the fixing apparatus involves delay in restarting even if interruption of photocopying is for a short time only. A further disadvantage is that the apparatus consumes substantial energy during the heating up period.

With a view to avoiding these disadvantages, the invention provides apparatus for fixing electrophotographic images produced by an electrophotographic copying machine, comprising a conveyor belt for transporting image bearing sheets on its upper run and a planar heater which extends substantially parallel to the upper run and is disposed closely above it but out of contact with the sheets.

Figure 1:
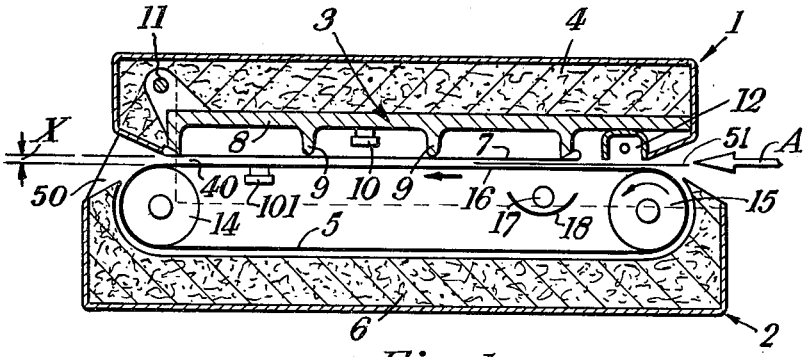
Figure 2:
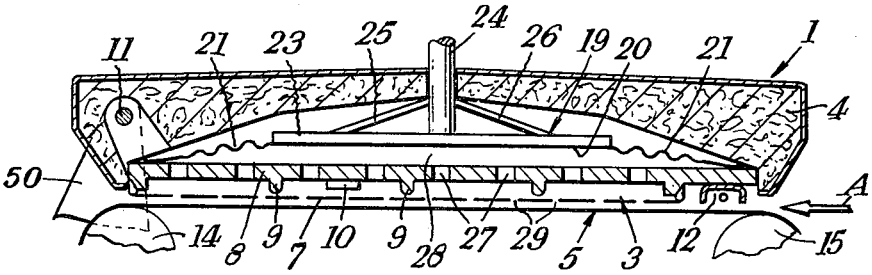
Figure 3:
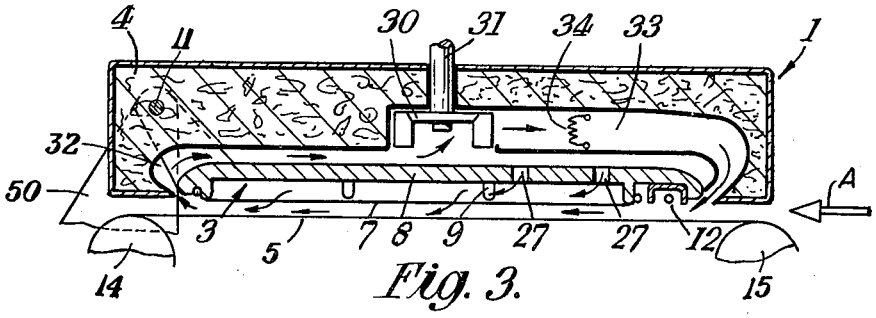
Figure 4:
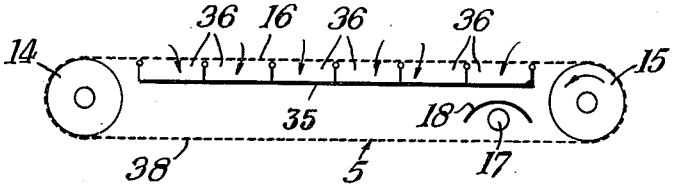
Figure 5:
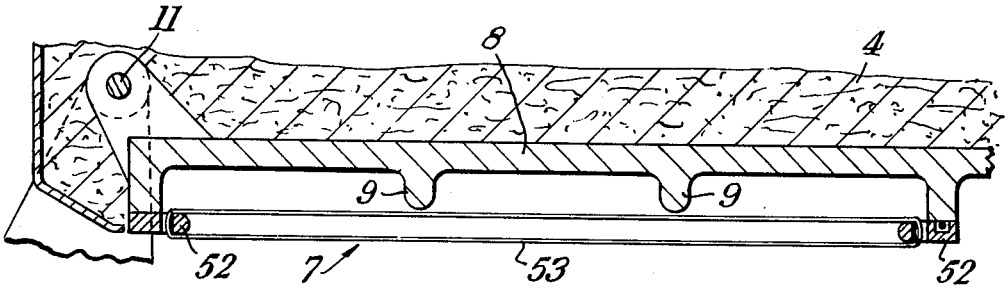
Figure 6:
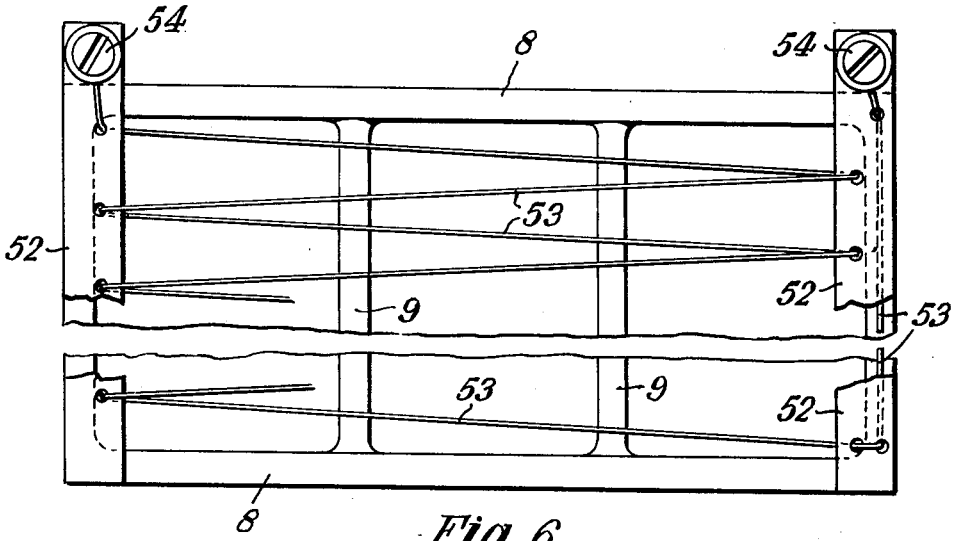
Figure 7:
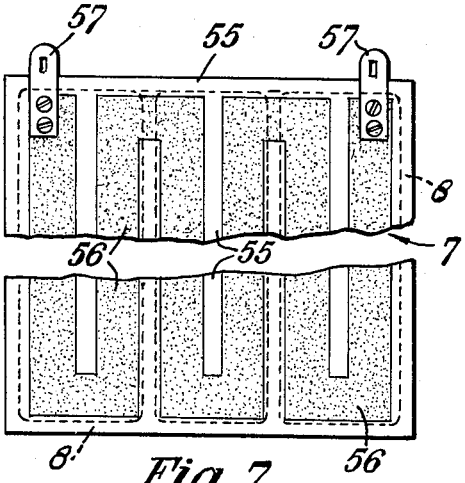
Figure 9:
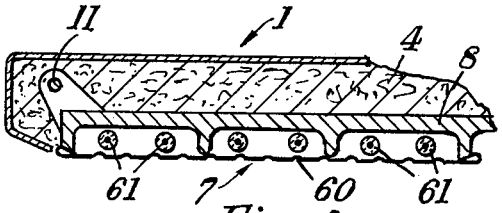
Figure 10:
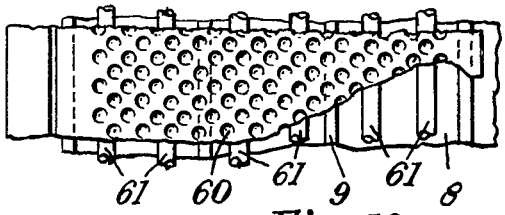
Figure 8:
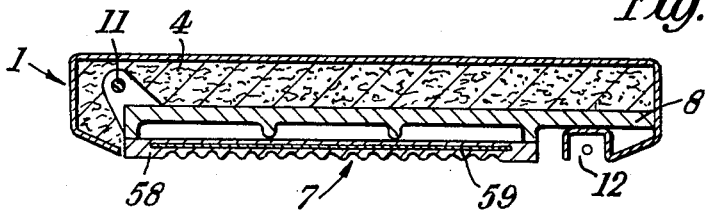

Certain embodiments of fixing apparatus according to the invention will now be described, by way of example, with reference to the accompanying diagrammatic drawings, in which:

FIG. 1 is a longitudinal section showing the first embodiment,

FIG. 2 is a similar view showing a modified form of the upper section of the apparatus, FIG. 3 is a similar view showing another modified form of the upper section, FIG. 4 is a similar view showing a modified form of the lower section of the apparatus, FIG. 5 is a cross-section of one form of planar heater, FIG. 6 is a corresponding underside plan view, FIG. 7 is an underside plan view of another form of the planar heater, FIG. 8 is a cross-section of still a further embodiment of the planar heater, FIG. 9 is a cross-section of yet another form of the planar heater, and FIG. 10 is a corresponding underside plan view.

Like reference numerals designate like parts throughout the Figures.

The apparatus shown in FIG. 1 consists of a lower section 2 and an upper section 1 pivoted by a pin 11 to upstanding lugs on the lower section, one of which is shown at 50. Sheets of material 51, each bearing an electrophotographic image which has been produced in a known manner by imagewise exposure to light in an electrophotographic copying machine (not shown) followed by application of toner powder, are fed in the direction indicated by the arrow A into the gap 40 between the sections 1 and 2, the width X of which can be varied by pivotal adjustment of the upper section 1 about the pin 11.

The material to be fixed is fed through the apparatus by the upper run 16 of a conveyor belt 5 which runs over drums 14, 15 in the lower section 2, at least one of these drums being driven from the copying machine.

The upper section 1 contains a heating element 3, backed by thermal insulation 4 and constituted by a planar heater 7 which extends substantially parallel to the upper run 16 of the conveyor belt 5 and is attached to projections 9 on a carrier plate 8. The heating element 3 includes a thermal sensor 10 which serves in known manner to maintain the temperature of the heating element at a predetermined value. The conveyor belt 5 in the lower section 2 is backed by thermal insulation 6. The belt 5 may be made of metal strip having, for example, a thickness of 60–70$\mu$, or of woven material.

The upper section 1 also contains, in advance of the heater 7 in the direction of travel of the sheets, a device 12 which produces a corona discharge to cause the image bearing sheets to adhere to the upper run 16 of the belt 5. The lower section contains a heater 17, backed by a reflector 18, for directing heat on to the portion of the upper run 16 of the belt leaving the drum 15. A thermal sensor 101 serves to control the temperature of the heater 17.

During passage through the apparatus the electrophotographic images are fixed by the heat from the heater 7 and by the heat supplied through the belt from the heater 17. The heat from the heater 7 is primarily responsible for fixation of the images and its transfer to the images is assisted by an air current caused to flow in the narrow gap 40 as the result of passage through the gap of the image bearing sheets.

The modified form of upper section 1 shown in FIG. 2 provides a more turbulent flow of air in the gap 40 created by a diaphragm pump 19, which includes a diaphragm 20 having folds 21 and attached at its rim to the carrier plate 8. The central portion of the diaphragm 20 is attached by a plate 23 and struts 25, 26 to a rod 24, to which reciprocation is imparted, e.g. by the armature of an electromagnet which is oscillated at a frequency of 50 Hz or by an electric motor. The pulsations of the air in the space 28 between the diaphragm 20 and the carrier plate 8 causes air to flow through holes 27 in the plate 8 and holes 29 in the heater 7 to and from the gap between the heater 7 and the upper run 16 of the conveyor belt, to intensify the transfer of heat from the heater 7 to the images.

The modified form of upper section 1 shown in FIG. 3 includes a fan 30 having a driving shaft 31 which is rotated by an electric motor, not shown. Air is drawn by the fan 30 from the outlet end of the gap between the two sections of the apparatus through a suction duct 32 and discharged to the inlet end of the gap through a duct 33 containing a heater 34, which preheats the air to prevent it from cooling the heater 7. Part of the preheated air also passes through the holes 27 in the plate 8 and corresponding holes (not shown) in the heater 7 to create turbulence as it enters the gap at right angles to the direction of flow of air in the gap from the outlet of the duct 33. Since the gap is narrow the fan 30 need only deliver a relatively small amount of air to effect intensive transfer of heat from the heater 7 to the images. If preferred, the fan can supply air to the gap in countercurrent to the direction of travel of the images.

If the upper section contains no corona discharge device for ensuring adhesion of the image bearing sheets to the upper run 16 of the conveyor belt, the lower section may provide such adhesion by a suction box 35 as shown in FIG. 4. The suction box 35 is disposed beneath the upper run 16 and consists of adjoining suction chambers 36 which are connected to a suction pump (not shown). The conveyor belt 5 is constituted by a perforated metal strip or may consist of two or more juxtaposed belts.

As soon as an image bearing sheet is introduced into the inlet of the gap between the two sections, its leading end is drawn down on to the upper run 16 of the belt by the air flowing into the first suction chamber 36 and so held to the upper run. As the sheet proceeds into the gap its whole area is progressively drawn by suction into adhesive contact with the belt.

The reflector 18 directs heat from the heater onto the bottom run 38 of the belt to preheat it and compensate for any cooling of the belt by the drum 15.

The planar heater 7 can, as shown in FIGS. 5 and 6 be constituted by two parallel bars 52, bridged by a heating coil 53 connected by terminals 54 to a source of electric current. It may, alternatively, as shown in FIG. 7 be constituted by a plate 55 of electrically insulating material provided with a galvanically deposited surface layer 56 of electrically conducting material connected by terminals 57 to a source of current. As a further alternative, as shown in FIG. 8, it may be a plate 58 containing an embedded heating element 59, in which case the surface of the plate facing the conveyor belt may be corrugated to improve the radiation of heat.

As a further and simpler alternative shown in FIGS. 9 and 10, the planar heating element 7 may be constituted by a foil 60 backed by individual radiant heaters 61 which heat the upper surface of the foil and cause its lower surface to radiate heat towards the conveyor belt. To ensure uniform heating of the space beneath the foil, the lower surface of the foil may be dimpled.

The heat transfer from the heater 7 to the image bearing sheets may be intensified by providing a blower which directs a cross flow of air across the entire width of the upper run 16 of the conveyor belt.

The heat transfer to the images may also be increased by imparting an oscillating movement to the heater 7. This oscillation may be parallel to the upper run 16 so that the width of the gap 40 remains unaltered. Alternatively it may be at right angles to the upper run so that the width of the gap is periodically changed. Such oscillation can be imparted to the heater mechanically or electromagnetically.

The various forms of fixing apparatus described require only a short time for heating up and involve relatively small energy losses. They are compact and can operate at low temperatures. They are suitable for operation at high speed and can accommodate all normal sheet sizes. Even sheets of large size, e.g. A3 and upwards, can be handled without folds developing in the sheets.

A further advantage is that none of the parts adjoining the gap 40 attain a temperature higher than the ignition point of the image bearing sheets, which are normally of paper. The sheets therefore will not catch fire should their passage through the apparatus be impeded for any reason.

What we claim as our invention and desire to secure by Letters Patent is:

1. An apparatus for fixing electrophotographic images on sheets of electrophotographic material which comprises a thermally insulated lower housing section, drums mounted for rotation about spaced-apart, horizontal axes disposed in said lower housing section, a thin metal conveyor belt guided around said drums and having a substantially horizontal upper surface operative to hold and transport said sheets through the apparatus, a thermally insulated upper housing section spaced apart from and supported by said lower housing section, and defining an inlet end and an outlet end, an electrical heater of planar configuration mounted in said upper housing section, said electrical heater having a lower surface which extends substantially parallel to the upper surface of said conveyor belt and disposed close to but not in contact with the sheets disposed on said upper surface of said conveyor belt, said spaced-apart upper and lower housing sections defining a conveying channel between the lower surface of the electrical heater and said sheets for the circulation of heated air therethrough, means for moving upwardly and downwardly the upper housing section substantially parallel to the lower housing section for adjusting the size of said conveying channel, and means for causing adhesion of said sheets to said upper surface of said conveyor belt so that said sheets are caused to lie flat on said conveyor belt as they are conveyed beneath the electrical heater from the inlet end to the outlet end thereof.

2. The apparatus of claim 1, wherein a carrier plate is disposed in the upper housing section, said carrier plate containing a plurality of projections which extend toward said conveying channel, said electrical heater being mounted on said projections.

3. The apparatus of claim 1, wherein the electrical heater comprises substantially parallel bars disposed in the upper housing section, said electrical heater being an electrical heating coil which extends between said bars.

4. The apparatus of claim 1, wherein the electrical heater comprises a plate of electrically insulating material containing a surface layer of electrically conducted material.

5. The apparatus of claim 1, wherein the electrical heater comprises a plate containing a heating element embedded therein, the surface of said plate which faces the conveyor belt being corrugated to improve the radiation of heat therefrom.

6. The apparatus of claim 1, wherein the electrical heater comprises a plurality of radiant heaters disposed in the upper housing section and a foil disposed between said radiant heaters and said channel, said radiant heaters heating the upper section of the foil and causing its lower surfaces to radiate heat towards the conveyor belt.

7. The apparatus of claim 6, wherein the lower surface of the foil is provided with a plurality of dimples.

8. The apparatus of claim 1, wherein the means associated with the upper housing section for adjusting the size of the channels is a pivoting means which pivotally adjusts the upper housing section with respect to the lower housing section.

9. The apparatus of claim 2, wherein the carrier plate and the electrical heater contain a plurality of apertures and a diaphragm pump is operatively disposed above said carrier plate and electrical heater for pumping air through said apertures into said conveying channel.

10. The apparatus of claim 1, wherein a carrier plate containing the electrical heater is disposed in the upper housing section, said carrier plate extending a distance from said upper housing section and from the inlet and outlet ends thereof so as to define a flow circulation channel around said carrier plate which communicates with said conveying channel, and fan means disposed above said carrier plate in said flow circulation channel for circulating the air therethrough.

11. The apparatus of claim 10, wherein a plurality of apertures is provided at one end of the carrier plate and heating means is disposed in the flow circulation channel.

12. The apparatus of claim 1, wherein a blower is provided for directing a flow of air across the entire width of the conveyor belt.

13. The apparatus of claim 1, wherein an additional heating means is disposed below the conveyor belt to heat said belt.

14. The apparatus of claim 1, wherein the adhesion means is a corona discharge device disposed adjacent said inlet end of the apparatus above the conveyor belt.

15. The apparatus of claim 1, wherein the conveyor belt is air-pervious and the adhesion means comprises a suction box disposed below the conveyor belt.

16. The apparatus of claim 1, wherein said thin metal conveyor belt has a thickness of 60 to 70 $\mu$.

17. An apparatus for fixing electrophotographic images on sheets of electrophotographic material which comprises a thermally insulated lower housing section, drums mounted for rotation about spaced-apart horizontal axes disposed in said lower housing section, a thin metal conveyor belt having a thickness of 60 to 70 $\mu$ guided around said drums and having a substantially horizontal upper surface operative to hold and transport said sheets through the apparatus, a thermally insulated upper housing section spaced apart from and supported by said lower housing section, and defining an inlet end and an outlet end, an electrical heater of planar configuration mounted in said upper housing section, said electrical heater having a lower surface which extends substantially parallel to the upper surface of said conveyor belt and disposed close to but not in contact with the sheet disposed on said upper surface of said conveyor belt, said spaced-apart upper and lower housing sections defining a conveying channel between the lower surface of the electrical heater and said sheets for the circulation of heated air therethrough, pivoting means connected with the upper housing section for moving upwardly and downwardly the upper housing section substantially parallel to the lower housing section, thereby varying the size of the channel between said upper and lower housing sections, additional heating means disposed below the conveyor belt for heating said belt, and a corona-discharge device disposed adjacent said inlet end of the apparatus above the conveyor belt for causing adhesion of said sheets to said upper surface of said conveyor belt thereby causing said sheets to lie flat on said conveyor belt as they are conveyed beneath the electrical heater from the inlet end to the outlet end thereof.

18. The apparatus of claim 17, wherein a blower is provided for directing a flow of air across the entire width of the conveyor belt.

* * * * *